US006336349B1

(12) United States Patent
Hauger et al.

(10) Patent No.: US 6,336,349 B1
(45) Date of Patent: Jan. 8, 2002

(54) METHOD FOR THE FLEXIBLE ROLLING OF A METALLIC STRIP

(75) Inventors: Andreas Hauger; Rainer Kopp, both of Aachen (DE)

(73) Assignee: Muhr und Bender KG, Attendorn (DE)

( * ) Notice: Subject to any disclaimer, the term of this patent is extended or adjusted under 35 U.S.C. 154(b) by 0 days.

(21) Appl. No.: 09/634,717

(22) Filed: Aug. 7, 2000

(30) Foreign Application Priority Data

Aug. 6, 1999 (DE) ..... 199 36 522
Aug. 20, 1999 (DE) ..... 199 39 166

(51) Int. Cl.[7] ..... B21B 31/07

(52) U.S. Cl. ..... 72/240; 72/9.1; 72/11.7; 72/241.8; 72/366.2

(58) Field of Search ..... 72/9.1, 9.2, 9.4, 72/11.7, 11.8, 12.7, 12.8, 240, 241.4, 241.8, 366.2

(56) References Cited

U.S. PATENT DOCUMENTS 3,913,363 A 10/1975 Fuji et al.
5,720,196 A * 2/1998 Tanai et al. ..... 72/241.8
5,960,657 A * 1/1999 Anbe et al. ..... 72/11.7

FOREIGN PATENT DOCUMENTS

DE 23 14 701 10/1973
JP 62-54505 * 3/1987 ..... 72/240
JP 63-50084 * 10/1988 ..... 72/240
JP 3-281010 * 12/1991 ..... 72/240

OTHER PUBLICATIONS

Patent Abstracts of Japan, M–88, Sep. 17, 1981, vol. 5/No. 147, Hitachi Seisakusho K.K., 56–77011 (A), Jun. 25, 1981, English Abstract.

Jean Jouet et al., Automatic Flatness Control at Solmer Hot Strip Mill Using the Lasershape Sensor, Iron and Steel Engineer, Aug. 1988, pp. 50–56.

Patent Abstracts of Japan, 10034216, Feb. 10, 1998, Furukawa Electric Co. Ltd., English Abstract.

Patent Abstracts of Japan, M–102, Dec. 17, 1981, vol. 5/No. 19, 56–117812(A), Sep. 16, 1981, Ishikawajima Harima Jukogyo K.K., English Abstact.

* cited by examiner

*Primary Examiner*—Ed Tolan
(74) *Attorney, Agent, or Firm*—Nixon Peabody LLP; David S. Safran

(57) ABSTRACT

A method for the flexible rolling of a metallic strip in which, during the rolling procedure, the metallic strip is lead through a roll gap which is formed between two working rolls, and during the rolling operation, the roll gap is deliberately changed in order to obtain different strip thicknesses over the length of the metallic strip. A good planeness of the metallic strip can be obtained, and particularly, also for relatively wide strips, in that, during each setting of the roll gap or directly afterward, the deflection curve bending line of the working roll is controlled depending on the setting of the roll gap for the achievement of planeness of the metallic strip.

15 Claims, 1 Drawing Sheet

METHOD FOR THE FLEXIBLE ROLLING OF A METALLIC STRIP

BACKGROUND OF THE INVENTION

1. Field of the Invention

The invention relates to a method for the flexible rolling of a metallic strip wherein, during the rolling procedure, the metallic strip is lead through a roll gap which is formed between two working rolls and during the rolling operation, the roll gap is deliberately changed in order to obtain different strip thicknesses over the length of the metallic strip.

2. Description of Related Art

Flexible rolling as a method for the production of planar metallic strips with different, default strip thicknesses over their length is known in practice. Flexible rolling is characterized in that the roll gap is deliberately changed during the rolling operation. While doing so, strip sections of different lengths are rolled with different thicknesses which can be connected to one another with different inclinations. The object of flexible rolling is to produce rolled stock with a load- and weight-optimized cross section. The method is designed, as is common, as strip rolling from coil to coil. Here, the winch-applied strip tension supports the rolling procedure and substantially improves the uniformity of the strip section in the longitudinal direction, i.e., in the rolling direction.

Rolling, in the context of the conventional strip rolling procedure, requires substantial energy for the deformation of the roll stock found in the intake zone leading to the roll gap—which leads to an elastic deflection of the roll. A deflection curve bending line which is almost parabolic and which corresponds to the axle center of the roll results through the deflection of the roll which is supported on both ends. Since the deflection causes a deviation from the uniform gap measure or the ideal gap, corrective measures are necessary.

One measure for correcting the deviation from the ideal gap—caused by the deflection of the rolls—consists of bowing the barrel-shaped or bellied construction of the roll body. With this type of correction, it is possible to bow only the working rolls, only the back-up rolls or both the working rolls and the back-up rolls. The bowing should compensate the deflection, which is caused by the roll force and the weight of the rolls, so that the gap between the rolls runs uniformly again, i.e., the gap is constant over the length of the rolls. Generally, the correction of the deflection curve bending line, however, is not complete and applies only to definite operational instances since the shape of the roll or the bowing is not changeable.

A further possibility for correction is seen in that, in each case, a roll body is placed oblique to its axis by a horizontal turning from the center of its line of contact with the corresponding roll. This oblique placement alters the gaps at the ends of the rolls while the center remains unchanged. Through its variation possibilities, the oblique placement of the rolls allows, particularly, for an approximated compensation of the deflection for almost all operational instances, but is comparable to the exactness obtainable with the already-mentioned parabolic surface of the roll body.

Furthermore, it is possible to create a moment of deflection through the application of forces on the bearing necks of the rolls which works against the moment of deflection in rolling. This biasing of the rolls also allows, like the oblique placement, an approximated compensation for almost all operational instances. The substantially increased stress on the bearing is, however, disadvantageous. In respect to the obtainable compensation, biasing can be compared with the parabolic surface.

Finally, a further possibility for correction exists in working roll cooling, which deals with thermal bowing.

It is understood that the already-mentioned correction possibilities for obtaining an ideal roll gap in rolling mills can be used alone or in combination with one another.

As opposed to the conventional strip rolling procedure, flexible rolling is especially problematic in that during the rolling process, large load fluctuations on the roll stand—which for one thing, no doubt, achieve the desired changes in strip thickness and for another, however, involve a substantial change of the roll load over the width particularly for wider metallic strips—constantly arise due to the frequent differences in thickness of the metallic strip. Through this, the deflection curve bending line of the working roll is influenced as is, consequently, the geometric formation of the roll gap and with it the planeness, as long as no correction to the implementation of a uniform gap measure follows. Should, in flexible rolling, the roll gap corresponding to the required strip section be run without correction, a characteristic, non-planar strip section develops over the width for this load change. Due to this non-planeness, there is the danger of corrugation on the edges or rips in the strip since the ordered alteration in height and the ordered alteration in length corresponding to it are not constant over the width. Because of this, different thickness result over the width and from this, different lengths which cause these flaws in the strip.

Planeness is a substantial requirement for a metallic strip. This is important in order to be able to insure the same proportions from the middle of the strip to the edge of the strip for further machining. Undesired effects can come about when winching strips that are not planar. This is expressed through frictional tension points on the contact areas in the winched coil either in the middle of the strip or at the edge of the strip depending on the strip section. This can lead the coiled strip to stick depending on the looping angle and the occurring frictional conditions, particularly if an annealing operation is performed afterward.

In the conventional strip rolling procedure for the production of planar metallic strips with a uniform thickness over the length, both the thickness of the strip and the planeness are constantly set, monitored over complex control loops and adjusted via corresponding correcting elements at occurring deviations. A control device for stabilizing the rolling-force-conditioned roll deflection in the conventional strip rolling procedure is known, for example, from German Patent DE 22 64 333 C3.

It is problematic that the known regulation needs a definite response time and a certain recovery time until it responds and until the effect of an alteration in the disturbance variable coming from the effect of the regulation withing the exactness of measurement is stabilized. This problem of the regulation response and the necessary recovery time plays a substantial role in flexible rolling since, in part, very short portions of strip with different thicknesses must be rolled at partially high rolling speeds and the planeness should, finally, be guaranteed over the entire length of the flexibly-rolled strip. This is particularly difficult, especially for wider metallic strips.

SUMMARY OF THE INVENTION

It is a primary object of the present invention to provide a method for flexible rolling of a metallic strip in which planeness can be well obtained, and particularly, also for relatively wide strips.

The above-mentioned and described object is met with a method of the type described above in which, during each setting of the roll gap or immediately thereafter, the deflection curve bending line is adjusted depending on the setting of the roll gap to obtain planeness in the metallic strip. It is thus substantial that the influence of the deflection curve bending line of the working roll while setting of the roll gap is not—at least not at first—achieved by feedback control, but instead from a control or an adjustment in which one variable—here, the deflection curve bending line of the working roll—is influenced by another variable—here, the roll gap in a pre-determined, fixed connection.

In the invention, the compensation of the deflection curve bending line alteration due to the load reversal from a roll gap alteration results through the knowledge of the dependence of the deflection curve bending line on each roll gap. If, for example, the roll gap for a particular rolled stock is adjusted from $S_1$ to $S_2$ this adjustment of the roll gap leads to an alteration of the deflection of the working roll. This deflection curve bending line alteration is known and forms the basis of adjustment compensation. The knowledge of the deflection curve bending line alteration can ensue from the default geometry, but can be especially empirically won, namely thereby that the corresponding measured variables are returned to during the rolling procedure.

As a result, the deflection curve bending line is adjusted depending directly on each roll gap via application, i.e., increase or reduction of a definite counteracting bending force, in order to keep a uniform gap measurement over the length of the roll gap. Through this adjusting interference on the rolling procedure while setting the roll gap, the metallic strip can be strategically worked on, and particularly, before possible following feedback controls are even effective in order to, finally, provide a metallic band which is planar over the entire width.

It is especially advantageous when the planeness is regulated, i.e., feedback controlled via at least one control loop after the control and especially immediately after the setting of the roll gap. The invention provides that, firstly, i.e., with the setting of the roll gap, merely one control is carried out. External disturbance variables, with the exception of the changing roll gap can not be taken into consideration in this case. However, if the adjusting intervention is finished, the feedback control responds in order to eliminate non-planeness remaining in the strip and therewith, to obtain a planar metallic strip.

During flexible rolling, it is necessary to multiply adjust the roll gap due to the default alteration in thickness of the metallic strip. Thus, it is further provided, according to the invention, that shortly before or during the renewed setting of the roll gap, the adjustment for planeness is interrupted and the deflection curve bending line of the working roll is newly controlled depending on the new roll gap. Hence, there is a continuous change between controlling and feedback control of the metallic strip depending on the default alterations of thickness over its length.

In a control, default counteracting bending forces on the working rolls and/or on the backup rolls dependent on the different roll gaps are applied in order to obtain a bending of the working rolls or of the back-up and working rolls. In regard to this, to feedback control, i.e., regulate non-planeness of the metallic strip, the counteracting bending force adjusted to each load instance is applied to the working rolls and/or back-up rolls in order to obtain, in any case, a bending of the working roll and/or a bending of the back-up and working rolls. The control, or regulation, mentioned is put into practice preferably with the said bending of the working and/or back-up rolls since, here, —corresponding to the running speed of the roll gap—alterations can be quickly implemented, which is especially important for flexible rolling with strip sections which are partly very short. Other possibilities are also conceivable for influencing the planeness, e.g. by the postponing of intermediary rolling with the six high stand, by hydraulic-supported rolling or by cross-rolling. However, the aim, in any case, is to produce a flexibly rolled strip and, at the same time, to improve or optimize the winchability of such metallic strips.

So that the regulation responds quickly to the control in the end, which, as already described, is of considerable importance especially for flexible rolling, it is suggested that the measuring of the planeness is done optically. The optical measurement of the planeness is easily implemented immediately behind the working rolls. Therewith, the planeness of the metallic strip is preferably measured over the entire width of the metallic band behind the roll gap for each increment of length.

It is especially preferred, in connection to the optical measurement, that thickness measuring laser stations are provided over the entire width of the metallic band and that the laser thickness measurement results via triangulation. The laser thickness measurement over the entire width of the metallic band allows an easy, on-line optimization of the deflection curve bending line of the working roll. The laser thickness measurement via triangulation allows the determination of the cross section also for short strip sections of around 50 mm long because of the small area of measurement and the high measurement frequency of 1 kHz.

It is understood that it is basically possible to use other methods than optical measurement for determining whether or not non-planeness remains in the strip after the control. A stress-metering roller, for example, can also be used.

By the way, it is advantageous to not only regulate the planeness of the metallic strip, but also the thickness of the strip in the longitudinal direction. This can be integrated in the control loop for the bending of the working roll.

Next the invention is explained more precisely with a drawing representing merely one embodiment.

DETAILED DESCRIPTION OF THE INVENTION

Figure 1:
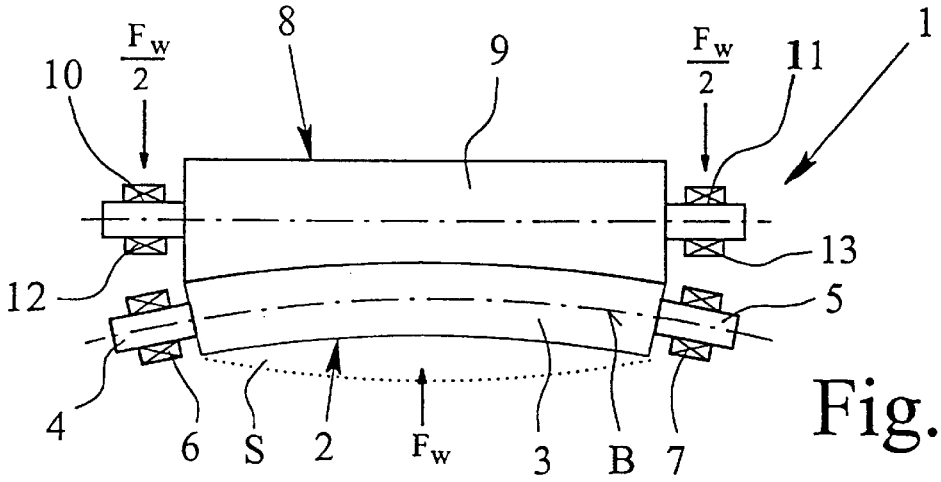
FIG. 1 a schematic representation of a part of the rolling stand without counter-bending.
Figure 2:
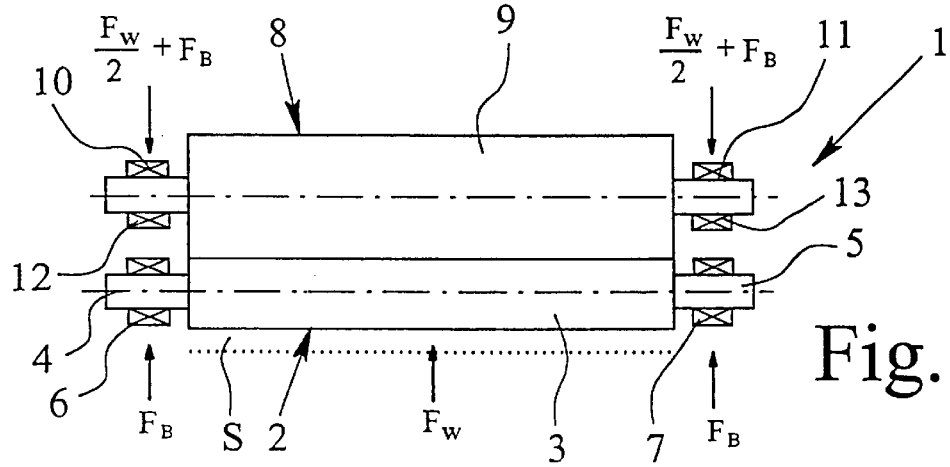
FIG. 2 a view of the rolling stand from FIG. 1 with counter-bending.

In FIGS. 1 and 2, a part of the rolling stand 1 is represented, on the one hand, without counter-bending (FIG.

1), and on the other hand, with counter-bending (FIG. 2). A cylindrical working roll 2 with roll bodies 3 and bearing necks 4, 5 which are arranged in bearings 6, 7 are shown. Above the working roll 2, there is a back-up roll 8 with a cylindrical back-up roll body 9 and bearing necks 10, 11 which are arranged in bearings 12, 13. The shown working roll 2 and the back-up roll 8 are the two upper-most rolls of the rolling stand 1. The corresponding two lower rolls are not shown, namely a lower working roll and a lower back-up roll, beyond the extent of a dotted line representation of the surface of the lower working roll facing the upper working roll. Between the two working rolls, there is a roll gap S.

It is understood that the invention can be used as both a four-high roll stand and a two-high roll stand and that instead of cylindrical working rolls 2 and back-up rolls 8, bow-shaped rolls, basically, can also be used.

In FIG. 1, an example is represented for application of the invention for use in the rolling to of a metallic strip, which is not shown, wherein a roll force $F_W$ is exerted on the working roll 2. The roll force $F_W$ causes an elastic bending of the working roll 2 so that the deflection curve bending line B of the working roll 2 results. The roll force $F_W$ leads, however, not only to a bending of the working roll 2, but also to a bending of the back-up roll 8 which, however, is not individually shown.

In FIG. 2, the state of the rolls 2, 8 with counter-bending is shown. The roll gap S has, in opposition to the state shown in FIG. 1, a constant, uniform gap, measure, so at least a constant distance that substantially remains the same between both areas of the working roll facing each other. In the state shown in FIG. 2, the working roll 2 is not curved. The roll force $F_W$ works against a counteracting bending force $F_B$ applied by the back-up roll 8.

In the shown embodiment, the deflection curve bending line B, which corresponds to the center axis of the working roll 2, runs parallel to the outside of the working roll 2. This is not the case with a bowed roll body 3. In this case of a roll gap which is constant over the length of the working roll, the working roll is curved—as opposed to the representation in FIG. 2—although the line or area of the working roll bordering the roll gap runs horizontally.

The method, according to the invention, for the flexible rolling of a metallic strip, proceeds so that the roll gap S is deliberately changed during the rolling operation in order to obtain a default alteration of thickness of the metallic band over its length. Firstly, it is significant that, during the setting of the roll gap S or immediately thereafter, the deflection curve bending line B of the working roll 2 is controlled depending on the set roll gap for the achievement of planeness of the metallic strip. This is possible through the knowledge of the dependencies of the deflection curve bending lines on the different roll gaps. Through this, the deviations due to the different roll gaps from the ideal gap are compensated.

Figure 3:
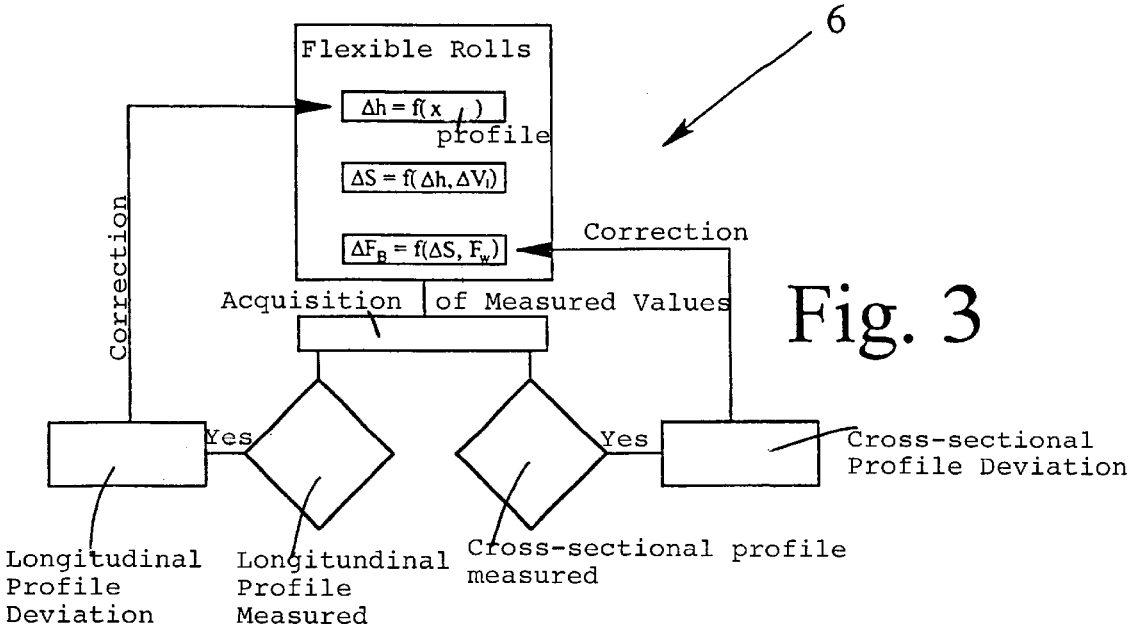
FIG. 3 is a representation of a control loop in accordance with the invention.

At the end of the controlling intervention described above with the setting of the roll gap, the planeness is feedback controlled, i.e., regulated via the control loop shown in FIG. 3. Hereby, the non-planeness remaining in the strip after the first controlling intervention are regulated. If the roll gap is reset later, the regulation is interrupted and the controlling of the defection curve bending line B is started again as described above.

In controlling depending on the different roll gaps, the default counteracting bending forces $F_B$ are applied on the back-up rolls 8, in order to obtain a bending of the working and backup rolls. With the same goal, the counteracting bending forces $F_B$ are also applied to the working rolls 2 to feedback control non-planeness.

In regulation, first, an acquisition of the measured values for corresponding measuring materials take place. Thereby, both the longitudinal profile and the cross section profile are measured. Directly following this, the recognition of the longitudinal profile and the cross section ensues, wherein the deviation between the actual value and the theoretical value of each controllable condition is determined. Each correction value is then lead to a control loop. With the recognition of the longitudinal profile, the alteration ah, corresponding to the default value, of the thickness of the metallic band is corrected to the default theoretical value. Concerning this, a corresponding alteration ΔS of the roll gap is necessary. The counteracting bending force $F_B$ needing to be applied to the working rolls 2 is, then again, dependent on the alteration of the roll gap S.

What is claimed is:

1. Method for the flexible rolling of a metallic strip, comprising the steps of, during a rolling procedure:

setting a roll gap which is formed between two working rolls, leading a metallic strip through the roll gap which is formed between two working rolls and, deliberately changing the roll gap to obtain different strip thicknesses over the length of the metallic strip, wherein, during setting of the roll gap or immediately thereafter, a deflection curve bending line of the working roll is controlled, depending directly on the extent to which the setting of the roll gap is adjusted during said setting step, for the achievement of planeness of the metallic strip.

2. Method according to claim 1, further comprising the step of regulating planeness of the metallic strip via at least one control loop immediately after a first setting of the roll gap.

3. Method according to claim 2, wherein, shortly before or during a re-setting of the roll gap, said control loop regulation is interrupted and the deflection curve bending line of the working rolls is controlled again for the achievement of planeness for the new roll gap setting.

4. Method according to of claim 1, comprising the further control step of applying default counteracting bending forces on at least one of the working rolls and on the back-up rolls dependent on the different roll gaps in order to obtain a bending thereof.

5. Method according to claim 2, wherein a feedback control is performed by adjusting the counteracting bending force to each load instance applied to at least one of the working rolls and back-up rolls in order to obtain a bending thereof.

6. Method according to claim 2, wherein said regulating step comprises the step of measuring the planeness of the metallic strip.

7. Method according to claim 6, wherein said measuring step is performed by a non-contact measurement technique.

8. Method according to claim 7, wherein said non-contact measurement technique is an optical measurement technique.

9. Method according to claim 6, wherein the planeness of the metallic strip is measured over the entire width of the metallic band behind the roll gap for each increment of length.

10. Method according to claim 8, wherein thickness measuring laser stations are provided over the entire width of the metallic band and wherein said optical measurement technique is a laser thickness measurement via triangulation.

11. Method according to claim 2, wherein said measuring step is performed by a contact measurement technique.

12. Method according to claim 11, wherein contact measurement technique is performed using a stress-metering roller.

13. Method according to claim 1, wherein the thickness of the metallic strip is feedback controlled in a longitudinal direction.

14. Method according to claim 6, wherein said measuring the planeness of the metallic strip comprises longitudinal and cross-sectional measuring of the metallic strip.

15. Method according to claim 14, wherein said step of regulating planeness of the metallic strip comprises feeding back of a correction value corresponding to any deviation between measured longitudinal and cross-sectional values of the metallic strip and theoretical values thereof.

* * * * *